United States Patent [19]

Collins et al.

[11] Patent Number: 4,799,602

[45] Date of Patent: Jan. 24, 1989

[54] PLUG LID FOR A CONTAINER

[75] Inventors: Malcolm G. Collins, Oxon; Adrien P. Rayner, Wiltshire, both of England

[73] Assignee: Metal Box p.l.c., United Kingdom

[21] Appl. No.: 175,439

[22] Filed: Mar. 30, 1988

[30] Foreign Application Priority Data

Apr. 8, 1987 [GB] United Kingdom ..... 8708428

[51] Int. Cl.[4] ..... B65D 39/00

[52] U.S. Cl. ..... 220/307; 220/74; 220/359

[58] Field of Search ..... 220/307, 74, 359, 354, 220/355, 356

[56] References Cited

U.S. PATENT DOCUMENTS

| | | | |
|---|---|---|---|
| 4,518,097 | 5/1985 | Milton et al. | 220/307 |
| 4,577,776 | 3/1986 | Rayner et al. | 220/307 |
| 4,606,474 | 8/1986 | Dudzik | 220/307 |
| 4,667,842 | 5/1987 | Collins | 220/307 |

FOREIGN PATENT DOCUMENTS

| | | |
|---|---|---|
| 2150540A | 7/1985 | United Kingdom . |
| 2168960A | 7/1986 | United Kingdom . |
| 2174672A | 11/1986 | United Kingdom . |

*Primary Examiner*—George T. Hall

*Attorney, Agent, or Firm*—Diller, Ramik & Wight

[57] ABSTRACT

A plug lid for fitting in an aperture in a container comprises a peripheral flange, a plug wall extending from the inner periphery of the flange, a retaining bead protruding laterally from the plug wall at a distance from the flange, an annular portion extending inwardly from the plug wall, a frustoconical portion extending axially and inwardly from the inner periphery of the annular portion to support a central panel in or near the plane of the peripheral flange. The annular portion joins the inside of the plug wall adjacent the retaining bead and extends inwardly and axially at an obtuse angle A° to the plug wall to join the frustoconical portion. The lids may be moulded from polyethylene, polypropylene or nylon.

9 Claims, 2 Drawing Sheets

PLUG LID FOR A CONTAINER

BACKGROUND OF THE INVENTION

1. Field of the Invention

This invention relates to plug lids for containers and more particular but not exclusively to a plug lid made of plastics material and adapted to fit in a plastics ring component of a container body.

2. Description of Related Art

Paint cans have traditionally been made out of tinplate to comprise a cylindrical body member to which are seamed a base closure member and an upper ring designed to receive a plug-fit tinplate lid. The performance of this lid has relied on there being an interference fit between the plug wall and the ring, the assembly operation therefore demanding elastic deformation of these components to achieve adequate lid retention during storage and transit.

Because of a variety of problems associated with the use of tinplate for such containers, including their ease of denting and the difficulty in preventing their internal rusting when containing water-based products, which now form the majority of all paint products, manufacturers have turned increasingly to the use of plastic containers which eliminate these costly disadvantages.

Generally such containers are made of either polypropylene or polyethylene to satisfactorily contain the water-based paints and are often injection moulded in one operation to incorporate base, body and ring. Alternatively, a cylindrical-walled pot may be moulded separately from the ring which is subsequently joined to the pot using an appropriate welding operation.

This fabricated pot and ring is used where there is a market requirement for a cylindrical-walled container that resembles the metal can in appearance and a concommittant implication is that the lid will be of a plug fit type rather than of an over-fitting type that generally extend radially beyond the wall of the container.

Now, because of the elastic nature of the plastic containers and their generally low coefficient of static and dynamic friction, the plug fit lids referred to above cannot rely solely on interference fit to resist the outward thrust of contents but require a radially-projecting bead on their wall portion, designed to hook beneath a correspondingly designed arrest feature on the ring.

An arrangement of ring and lid fit is described in British patent No. 2150540 wherein the retention bead of the lid projects radially outwards underneath the sealing lip of the ring. Of necessity, either the ring or lid or both has to accept and accommodate elastic deformation in order to achieve the assembled configuration shown and it is precisely because of this ability to deform and the inadequacy of design that plastic lids to date have shown very poor retention characteristics when subjected to the thrust of contained fluid contents arising when a container is dropped onto a surface.

SUMMARY

It is the object of the present invention to provide a plastic plug-fit lever lid that is both easy to assemble and remove whilst exhibiting extraordinarily good retention characteristics when subjected to the various abuse tests used in the art to simulate in-service punishment.

A further object is to provide an easily mouldable lid. Accordingly this invention provides a plug lid for fitting in an aperture in a container, said plug lid comprising a peripheral flange, a plug wall extending from the inner periphery of the flange, a retaining bead protruding laterally from the plug wall at a distance from the flange, an annular portion extending inwardly from the plug wall, a frustoconical extending axially and inwardly from the annular portion to support a central panel in or near the plane of the peripheral flange, characterised in that, the annular portion joins the inside of the plug wall adjacent the retaining bead and extends inwardly and axially at an obtuse angle to the plug wall in the range 95° to 120° to join directly to the periphery of the frustoconical portion.

Preferably the annular portion of the plug lid extends inwardly and axially at an angle of about 110° to the plug wall.

The annular portion of the plug lid preferably extends a radial distance of between 5 mm and 20 mm inwardly from the plug wall. More preferably, it extends a radial distance of at least 10 mm.

The frustoconical portion preferably has a projected included cone angle of about 90°.

The plug lid may be injection moulded in an elastomeric material chosen from a group consisting of polyethylene, polypropylene and nylon.

DESCRIPTION OF THE PREFERRED EMBODIMENTS

Figure 1:
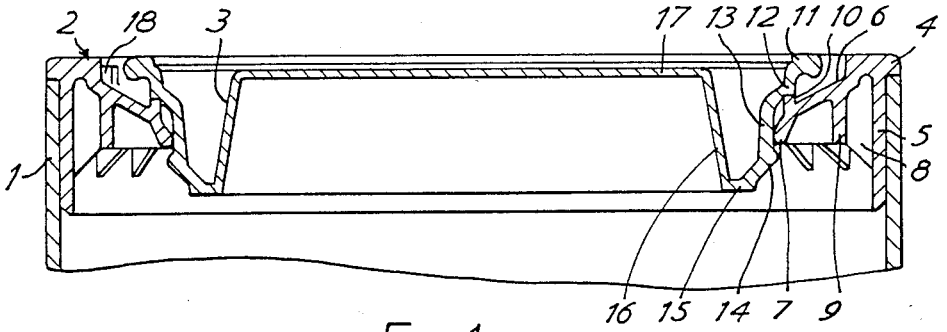
FIG. 1 is a sectioned side view of a prior art form of plug lid and part of a container in which the lid fits.

FIG. 1 shows one embodiment of a container body 1, ring 2, and plug lid 3, each moulded in a plastics material and described in our British Pat. No. 2150540. The container body has the cylindrical sidewall 1 closed at one end by the ring 2 and lid 3 (not shown). Any reader requiring more detailed description is referred to GB No. 2150540.

The ring 2 comprises a flange 4 from which extends an annulus 5 which fits inside the end of the body 1. A ring portion 6 extends axially and radially inwards from the flange to terminate at a sealing collar 7. A combination of radial fins 8 and annular fin 9, on the underside of the ring portion 6, serve to stiffen the ring 2. An abutment ring 10 extends upwardly from the upper surface of the ring portion 6 to abutt the lid 3 and prevent the lid passing through the ring.

The lid 3 of FIG. 1 comprises a flange 11, a step portion 12 against which the abutment ring 10 abutts, a plug wall 13, which seals against the sealing collar 7, a retaining bead 14 protruding from the plug wall to reach under the sealing collar 7, a substantially flat annular portion 15 extending radially inward from the plug wall, and a frustoconical wall 16, extending axially and upwardly, (as shown in FIG. 1) to support a central panel 17 of the lid 3.

Whilst the prior art ring 2 of FIG. 1 is currently spin welded to the body 1 by use of drive dogs, one of which is denoted 18, the ring may, if desired, be fixed by adhesive, or ultrasonic welding, or other means. The ring 2 is made relatively stiff by means of its ribbed structure but sealing is achieved by use of the flexible sealing collar structure. When the container of FIG. 1 is full of fluid such as paint and dropped or toppled, the hydraulic surge load is believed to cause at least part of the hollow lid, defined by the frustoconical wall and central panel, to move outwards so bending the substantially flat annular panel outwardly and dragging the retaining bead away from the sealing collar so that the retaining bead may, at least locally, pass through the sealing collar and at worst release the whole lid to spill paint.

Figure 2:
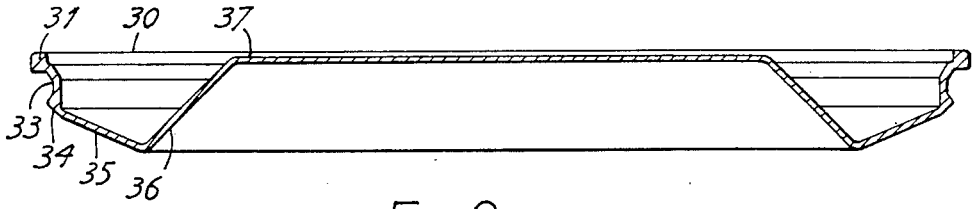
FIG. 2 is a side view of a plug lid according to this invention sectioned on a diameter.
Figure 3:
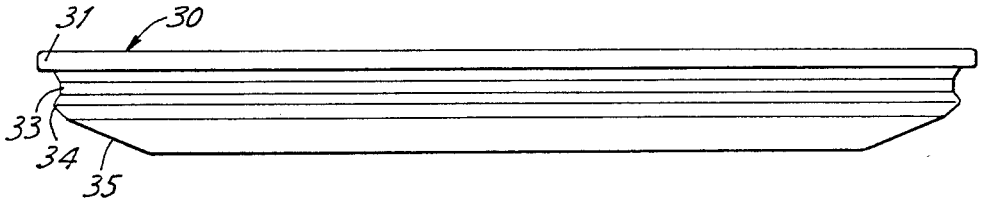
FIG. 3 is a side view of the lid of FIG. 2.
Figure 4:
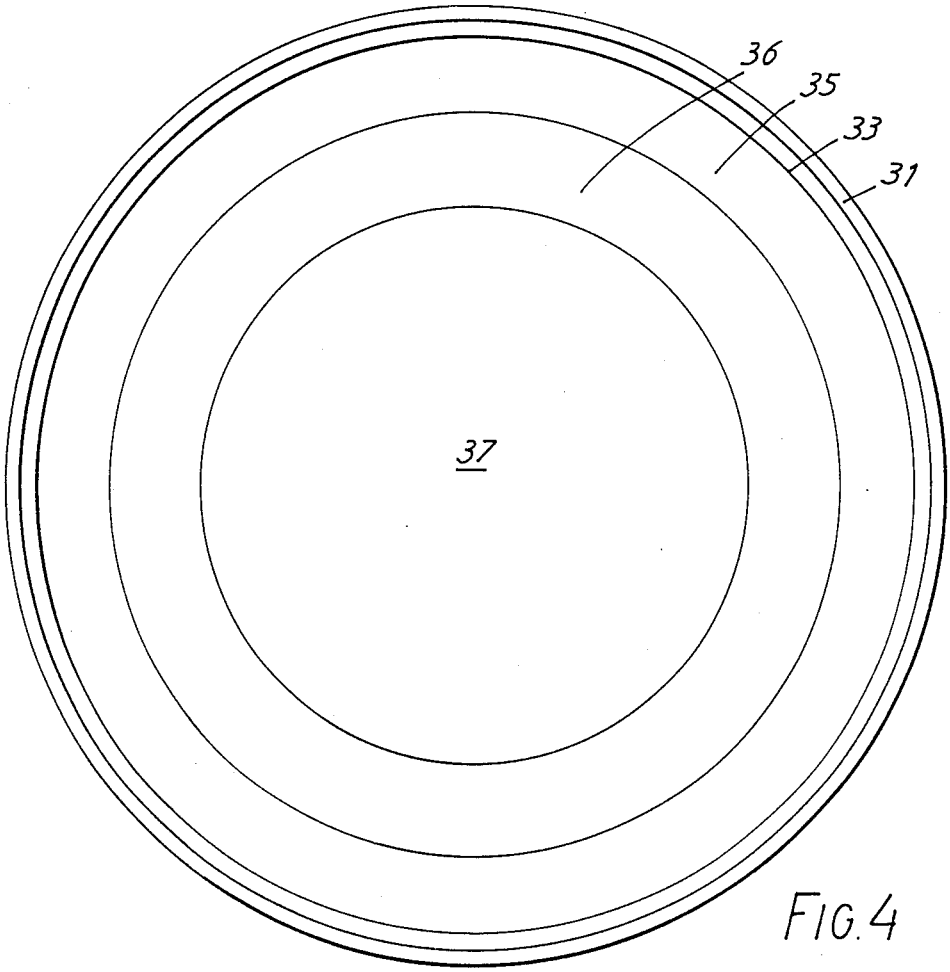
FIG. 4 is a plan view of the lid of FIG. 2.

FIGS. 2, 3 and 4 show a lid 30 according to this invention. The lid has a flange 31, a plug wall 33 depending from the flange, a retaining bead 34 protruding from the exterior of the plug wall at a distance from the flange 31, a dished annular wall 35 extending axially and inwardly from the retaining bead 34, and a frustoconical wall 36 extending axially and upwardly (as shown in FIG. 2) from the interior of the annular wall to support a central panel 37.

Figure 5:
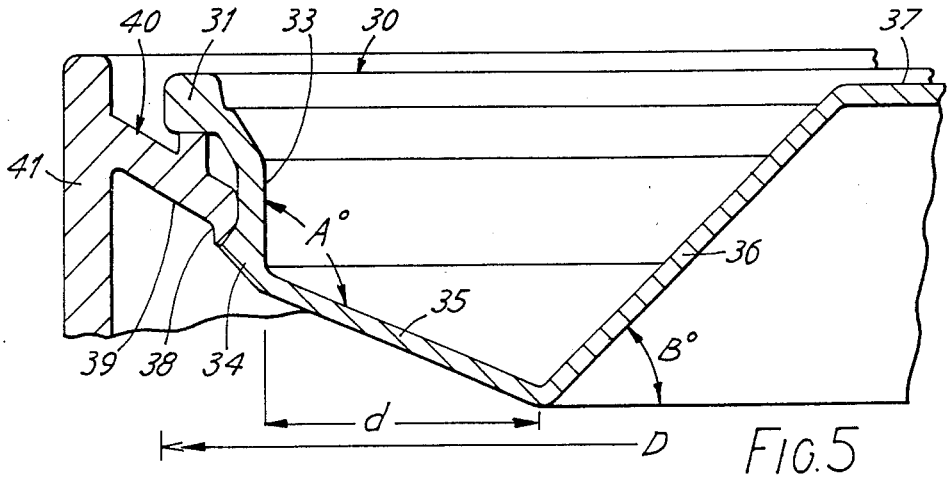
FIG. 5 is an enlarged fragmentary section of the lid of FIG. 2.

Referring to FIG. 5 it will be seen that, in contrast to the substantially flat and quite narrow annular portion 15 of FIG. 1 (prior art), the dished annular wall 35 of FIGS. 2 to 6 extends from the plug wall 33, behind the retaining bead 34, at an obtuse angle to the plug wall; this obtuse angle is denoted Ao in FIG. 5. Movement of the central portions 37, 36 of the lid under hydraulic forces, such as may arise during abuse of a filled container, therefore pulls the annular portion upwardly to spread in the manner of a flattening core plug and so trust the retaining bead 34 more tightly under the sealing collar 38 of the ring portion 39 of a modified ring 40.

The modified ring 40 is narrower than the ring 2 of FIG. 1 and does not have the stiffening fins 8, 9. In a further modification the ring 40 may, if desired, be moulded integral with the side wall 41 of the container.

The radial width "d" of the annular wall 35 may be in the range of 5 mm to 20 mm. If the radial width "d" is too short it offers little support to the retaining bead 34 and behaves no better than that of the lid of FIG. 1.

The obtuse angle of inclination of annular wall 35 to the plug wall 33 may be in the range of 95° to 120°. An additional benefit arising from the downwards inclination of annular wall 35 is that, during prising open of the lid from the ring by means of a lever, the wall can be flexed elastically to release the lid more easily than was the case with the substantially flat annular wall 15 of FIG. 1.

It is desirable that the frustoconical wall 36, which joins the inner periphery of the annular wall 35 to the central panel 37, be inclined at an angle B° in the range 40° to 50° A preferred angle is about 45° in order to give adequate support for the central panel 37 on which other cans may be stacked and yet still deliver the pull on the inner periphery of the annular wall 35 when a surge load arises.

A lid of diameter "D"=170 mm having an angle of inclination A°=110° (for annular wall 35 to plug wall 33) and width "d"=15 mm and angle B°=45° was fitted into a filled 1 US gallon container having the ring 40 as shown in FIG. 5.

The improvement in performance brought about by the use of a design of lid described by this invention can be illustrated by reference to the results of the very stringent nose drop test wherein a filled container is suspended upside-down above a smooth concrete platform such that its centre of gravity is directly above the corner of the container. The height of free fall onto the concrete such a container will withstand at 20° C. without release of the lid, and hence contents, is a recognised criterion of performance in the art. In a polypropylene container of diameter of 170 mm and height 195 mm, and dimensioned to contain one US gallon, a lid of the type illustrated in FIG. 1 just survived a drop height of 6 cm whereas a lid according to the present invention made of the same grade of polypropylene survived a drop height of 12 cm. This is a very substantial improvement in terms of container integrity as can be illustrated by reference to another test wherein the same filled and lidded containers are equilibrated at 35° C. and simply allowed to topple over to more closely simulate container performance on a hot summers day. The lid according to FIG. 1 would be thrust out without hesitation whereas the lid according to the present invention would remain closed even if pushed over in a forcible a manner as is manually possible.

In one method of fitting the lids described into the ring of a paint container, the filled container is taken to a lidding station at which a lid is laid upon a ring. The container and lid then pass under a heavy wheel of broad width which progressively "rolls" the lid into the ring. There is a possibility that this "progressive" lidding action will cause the lids of FIGS. 2 to 5 to tilt and enter at an undesirably skew angle to the axis of the ring.

Figure 6:
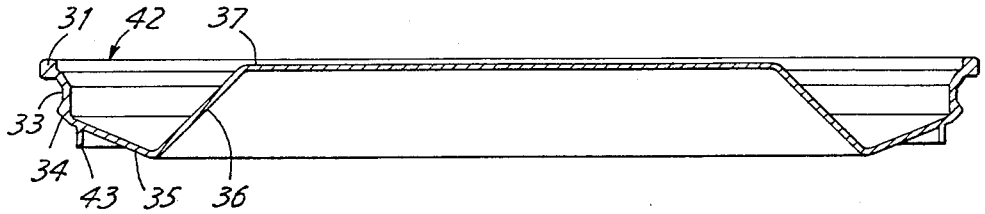
FIG. 6 is a sectioned side view of a modified form of the lid of FIG. 2.

FIG. 6 shows a lid modified to overcome the risk of skewing. In FIG. 6 the lid 42 is identical in all respects with the lid of FIGS. 2 to 5 so like parts are denoted by the same part numbers. However, in FIG. 6 a cylindrical collar 43 extends from the underside of the annular wall 35 slightly inboard of the plug wall 33 to serve as a seeker collar which seeks the aperture in the ring 39 and prevents tilting in the sealing collar 38.

The lids may be moulded in a plastics material; Pereferably an elastomeric material is chosen from a group consisting of polyethylene, polypropylene or nylon. The inclination of the annular wall 35 permits flexure after moulding so the retaining bead is easier to eject from the mould by means of pins near the outer periphery of the wall 35.

We claim:

1. A plug lid for fitting in an aperture in a container, said plug lid comprising a peripheral flange, a plug wall extending from the inner periphery of the flange, a retaining bead protruding laterally from the plug wall at a distance from the flange, an annular portion extending inwardly from the plug wall, a frustoconical portion extending axially and inwardly from the annular portion to support a central panel in or near the plane of the peripheral flange, characterised in that, the annular portion joins the inside of the plug wall adjacent the retaining bead and extends inwardly and axially at an obtuse angle to the plug wall in the range 95° to 120° to join directly to the periphery of the frustoconical portion.

2. A plug lid according to claim 1 wherein the angle at which the annular wall extends is about 110°.

3. A plug lid according to claim 1 wherein the annular portion extends a radial distance of between 5 mm and 20 mm inwardly from the plug wall.

4. A plug lid according to claim 3 wherein the annular portion extends a radial distance of at least 10 mm.

5. A plug lid according to any preceding claim wherein the frustoconical portion has a projected included cone angle of about 90°.

6. A plug lid according to claim 1 when injection moulded in an elastomeric material chosen from a group consisting of polyethylene, prolypropylene and nylon.

7. A plug lid according to claim 2 wherein the frusto-conical portion has a projected included cone angle of about 90°.

8. A plug lid according to claim 3 wherein the frusto-conical portion has a projected included cone angle of about 90°.

9. A plug lid according to claim 4 wherein the frusto-conical portion has a projected included cone angle of about 90°.

* * * * *